US010859302B2

(12) United States Patent
Besore et al.

(10) Patent No.: US 10,859,302 B2
(45) Date of Patent: Dec. 8, 2020

(54) REFRIGERATOR APPLIANCE WITH FLEXIBLE DOOR-IN-DOOR COMPARTMENTS

(71) Applicant: Haier US Appliance Solutions, Inc., Wilmington, DE (US)

(72) Inventors: John Keith Besore, Prospect, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 71 days.

(21) Appl. No.: 16/142,047

(22) Filed: Sep. 26, 2018

(65) Prior Publication Data

US 2020/0096245 A1 Mar. 26, 2020

(51) Int. Cl.

| | |
|---|---|
| ***F25D 23/02*** | (2006.01) |
| ***F25D 11/02*** | (2006.01) |
| ***F25D 17/04*** | (2006.01) |
| ***F25D 25/00*** | (2006.01) |
| ***F25D 25/02*** | (2006.01) |

(52) U.S. Cl.

CPC ..... *F25D 17/045* (2013.01); *F25D 11/02* (2013.01); *F25D 23/028* (2013.01); *F25D 25/005* (2013.01); *F25D 25/02* (2013.01); *F25D 2201/10* (2013.01); *F25D 2323/021* (2013.01); *F25D 2323/023* (2013.01)

(58) Field of Classification Search

CPC ..... F25D 23/02; F25D 23/025; F25D 23/028; F25D 23/04; F25D 2317/06; F25D 2317/061; F25D 2317/062; F25D 2317/063; F25D 2323/023; F25D 2323/024; F25D 17/045; F25D 11/02; F25D 25/005; F25D 25/02

See application file for complete search history.

(56) References Cited

U.S. PATENT DOCUMENTS

| | | | | |
|---|---|---|---|---|
| 2,712,733 | A | 7/1955 | King | |
| 2,745,259 | A | 5/1956 | Saunders | |
| 3,005,321 | A | 10/1961 | Devery | |
| 5,209,082 | A | 5/1993 | Ha | |
| 9,353,983 | B2 | 5/2016 | Mitchell et al. | |
| 2017/0082351 | A1* | 3/2017 | Jung | F25D 23/025 |
| 2017/0191740 | A1* | 7/2017 | Jung | A47B 88/437 |

FOREIGN PATENT DOCUMENTS

| | | | |
|---|---|---|---|
| EP | 2789937 | A1 | 10/2014 |
| JP | 2004211977 | A | 7/2004 |
| JP | 5409704 | B2 | 2/2014 |
| WO | WO2011107029 | A1 | 9/2011 |

* cited by examiner

*Primary Examiner* — Frantz F Jules
*Assistant Examiner* — Erik Mendoza-Wilkenfel
(74) *Attorney, Agent, or Firm* — Dority & Manning, P.A.

(57) ABSTRACT

A refrigerator appliance includes a cabinet that defines a chilled chamber. A door is rotatably mounted to the cabinet at a front portion of the chilled chamber. A plurality of flexible chambers are defined within the door. The refrigerator appliance also includes a sealed system configured for generating chilled air. The sealed system is in fluid communication with each of the plurality of flexible chambers to selectively provide the chilled air to at least one of the plurality of flexible chambers.

18 Claims, 9 Drawing Sheets

REFRIGERATOR APPLIANCE WITH FLEXIBLE DOOR-IN-DOOR COMPARTMENTS

FIELD OF THE INVENTION

The present disclosure relates generally to refrigerator appliances. In particular, the present disclosure relates to refrigerator appliances having flexible door-in-door compartments.

BACKGROUND OF THE INVENTION

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In certain refrigerator appliances, commonly referred to as side-by-side style refrigerator appliance, the fresh food chamber is positioned next to the freezer chamber within the cabinet. Such a configuration can permit easy access to food items stored on doors of the refrigerator appliances. However, the cabinet can be deep and narrow such that accessing food items at a back of the fresh food chamber and/or freezer chamber is difficult.

In other refrigerator appliances, the freezer chamber is positioned either above or below the fresh food chamber in the cabinet, which are commonly referred to as top mount or bottom mount refrigerator appliances. Such a configuration can provide a relatively wide fresh food chamber and/or freezer chamber, e.g., as compared to the side-by-side configuration. However, the depth of the fresh food chamber and the freezer chamber can make accessing food items at a back of the refrigerator appliance difficult.

Accordingly, a refrigerator appliance with features for assisting with accessing food items stored therein would be useful.

BRIEF DESCRIPTION OF THE INVENTION

Aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction and a transverse direction. The vertical, lateral and transverse directions are mutually perpendicular. The refrigerator appliance includes a cabinet extending from a top to a bottom along the vertical direction. The cabinet also extends from a left side to a right side along the lateral direction. The cabinet defines a fresh food chamber. The fresh food chamber extends along the vertical direction between the top and bottom of the cabinet, along the lateral direction between the left side and the right side of the cabinet, and along the transverse direction between a front portion and a back portion. The front portion of the fresh food storage chamber defines an opening for receipt of food items. A door is rotatably mounted to the cabinet at the front portion of the fresh food storage chamber such that the door rotates between a closed position where the door sealingly encloses at least a portion of the fresh food storage chamber and an open position to permit access to the fresh food chamber. The door includes an outer casing comprising a thermally insulated wall that defines a plurality of flexible chambers within the outer casing and a front panel rotatably mounted to the outer casing of the door such that the front panel of the door permits access to the plurality of flexible chambers when the door is in the closed position. The refrigerator appliance also includes a sealed system configured for generating chilled air. The sealed system is in fluid communication with each of the plurality of flexible chambers and selectively provides the chilled air to at least one of the plurality of flexible chambers.

In another exemplary embodiment, a refrigerator appliance is provided. The refrigerator appliance includes a cabinet that defines a chilled chamber. The chilled chamber includes a front portion and an opening for receipt of food items. A door is rotatably mounted to the cabinet at the front portion of the chilled chamber such that the door rotates between a closed position where the door sealingly encloses the at least a portion of the chilled chamber and an open position to permit access to the chilled chamber. The door includes an outer casing comprising a thermally insulated wall that defines a plurality of flexible chambers within the outer casing and a front panel rotatably mounted to the outer casing of the door such that the front panel of the door permits access to the plurality of flexible chambers when the door is in the closed position. The refrigerator appliance also includes a sealed system configured for generating chilled air. The sealed system is in fluid communication with each of the plurality of flexible chambers to selectively provide the chilled air to at least one of the plurality of flexible chambers.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
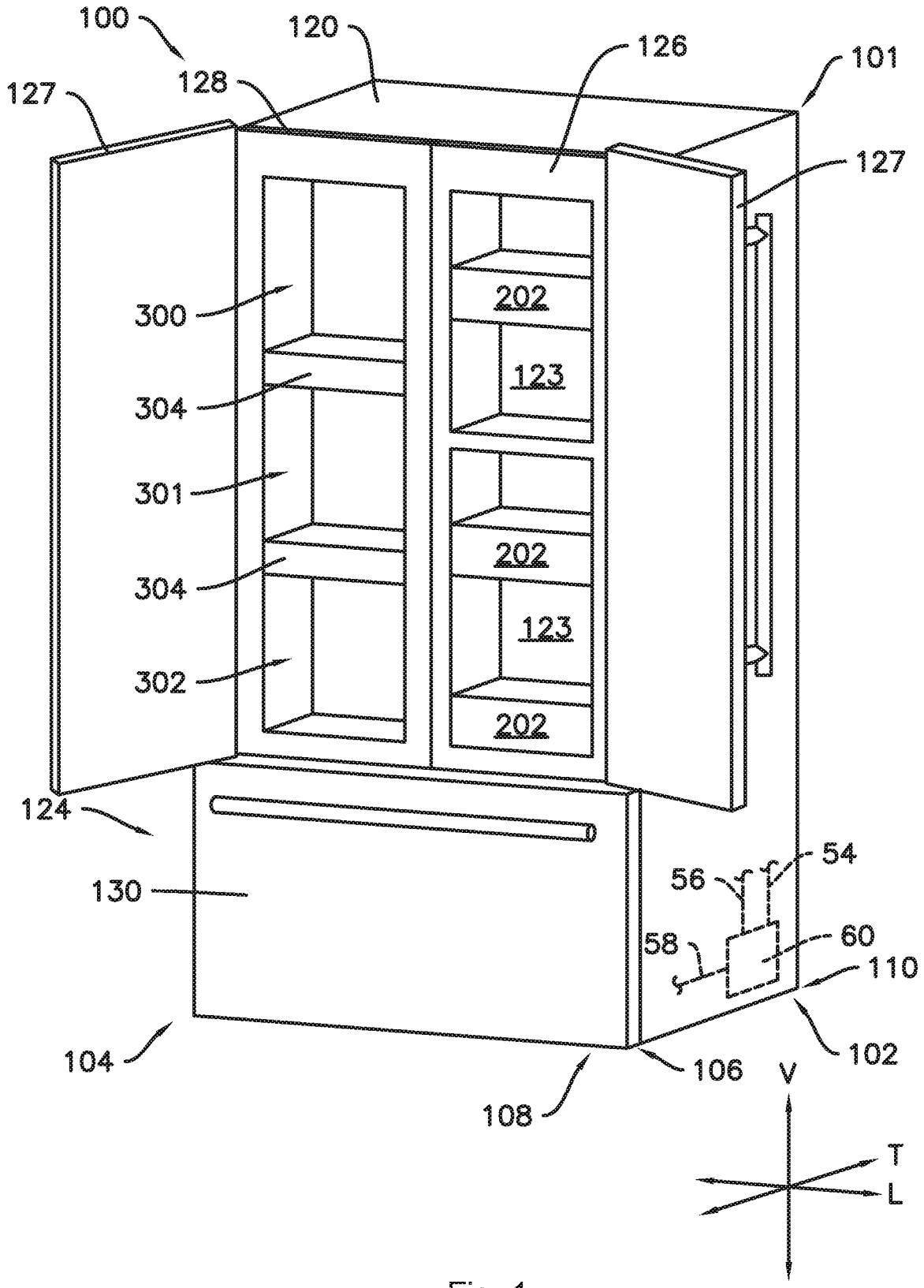
FIG. 1 provides a perspective view of an exemplary refrigerator appliance according to one or more embodiments of the present subject matter with a front panel of a door in an open position while the door is in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

FIG. 1 provides a perspective view of an exemplary refrigerator appliance 100 according to one or more embodiments of the present subject matter.

Refrigerator appliance 100 defines a vertical direction V, a lateral direction L, and a transverse direction T, each mutually perpendicular to one another. As may be seen in, e.g., FIG. 1, refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines chilled chambers for receipt of food items for storage. As used herein, a chamber may be "chilled" in that the chamber is operable at temperatures below room temperature, e.g., less than about seventy-five degrees Fahrenheit (75° F.). In the exemplary embodiment, housing 120 also defines a mechanical compartment at or near the bottom 102 of the cabinet 120 for receipt of a sealed cooling system 60. One or more conduits, e.g., conduits 54, 56, and 58 as illustrated for example in FIG. 1 may extend between the cooling system 60 and the chilled chambers to provide fluid communication therebetween, e.g., to provide chilled air from the sealed cooling system to one or more of the chilled chambers. The structure and function of such sealed systems are understood by those of ordinary skill in the art and are not described in further detail herein for the sake of brevity and clarity.

In particular, housing 120 defines a fresh food chamber 122 and a freezer chamber 124 spaced apart from the fresh food chamber 122 along the vertical direction V. For example, in the illustrated embodiment of FIGS. 1 and 2, fresh food chamber 122 is positioned at or adjacent top 101 of housing 120 and freezer chamber 124 is arranged at or adjacent bottom 102 of housing 120. As such, refrigerator appliance 100 is generally referred to as a bottom mount refrigerator. It is recognized, however, that the benefits of the present disclosure may apply to other types and styles of refrigerator appliances such as, e.g., a top mount refrigerator appliance, or a side-by-side style refrigerator appliance. Consequently, the description set forth herein is for illustrative purposes only and is not intended to be limiting in any aspect to any particular refrigerator chamber configuration.

Figure 2:
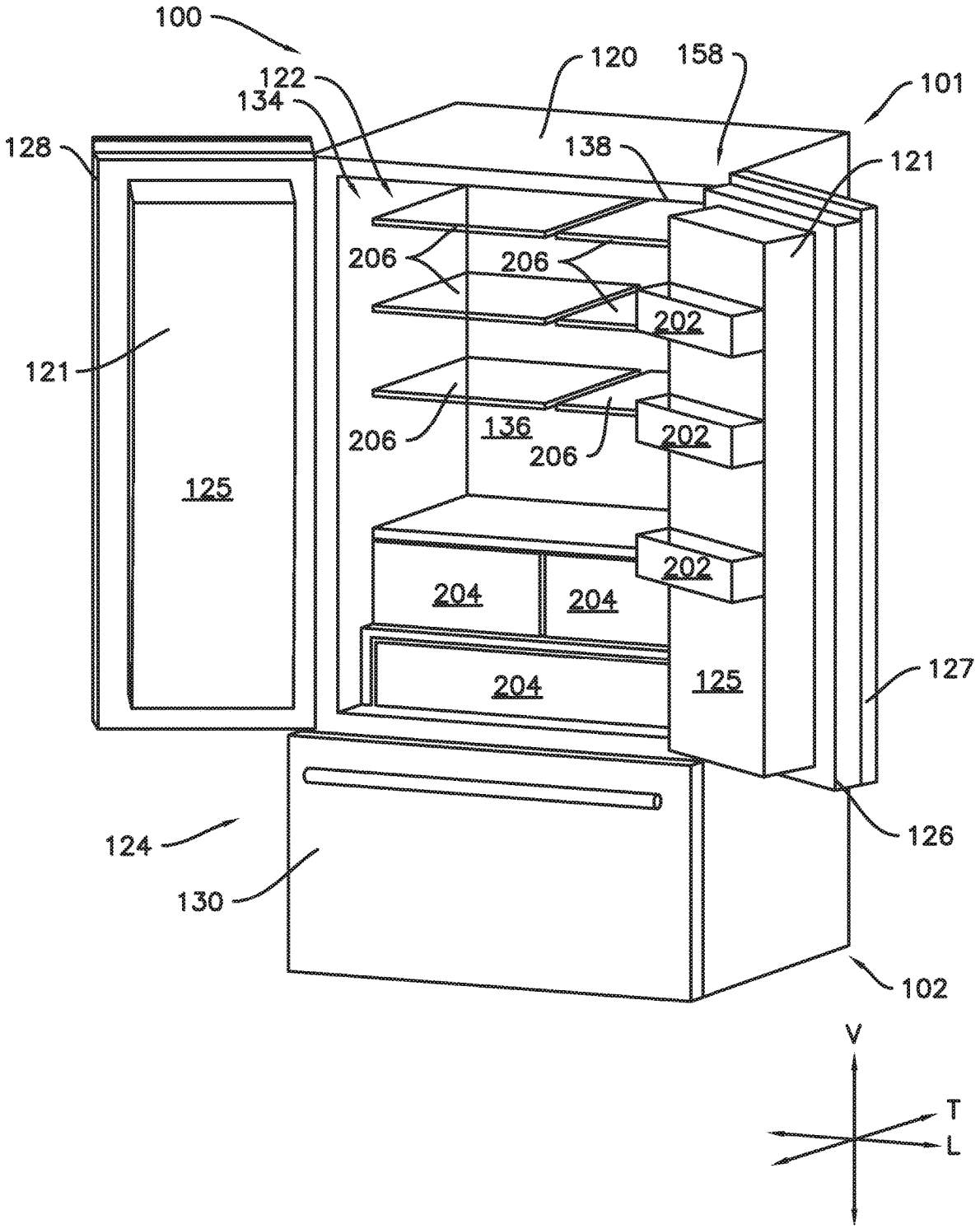
FIG. 2 provides a perspective view of the refrigerator appliance of FIG. 1 with a first fresh food chamber door and a second fresh food chamber door both in an open position.

As may be seen in FIG. 2, the fresh food chamber 122 extends along the vertical direction V between the top 101 and the bottom 102 of the cabinet 120 and along the lateral direction L between the left side 104 and the right side 106 of the cabinet 120. The fresh food chamber 122 also extends along the transverse direction T between a front portion 134 and a back portion 136. The front portion 134 of the fresh food storage chamber 122 defines an opening 138 for receipt of food items.

Refrigerator doors 126 and 128 are rotatably mounted, e.g., hinged, to an edge of housing 120 for selectively accessing fresh food chamber 122. Since refrigerator doors 126 and 128 correspond to the fresh food chamber 122, the refrigerator doors 126 and 128 may also be referred to as fresh food chamber doors. Refrigerator doors 126 and 128 may be mounted to the housing 120 at or near the front portion 134 of the fresh food storage chamber 122 such that the doors 126 and 128 rotate between a closed position (FIG. 1) where the doors 126 and 128 cooperatively sealingly enclose the fresh food storage chamber 122 and an open position (FIG. 2) to permit access to the fresh food chamber 122. The doors 126 and 128 may be generally mirrored, e.g., the overall shape and size of each door 126, 128 may be the same as the other door 126, 128, with possible internal variations. In addition, a freezer door 130 is arranged below refrigerator doors 126 and 128 for selectively accessing freezer chamber 124. Freezer door 130 is coupled to a freezer drawer (not shown) slidably mounted within freezer chamber 124. Refrigerator doors 126, 128 and freezer door 130 are shown in the closed configuration in FIG. 1.

As shown for example in FIGS. 1 and 2, various storage components are mounted within the chilled chambers to facilitate storage of food items therein as will be understood by those skilled in the art. In particular, the storage components may include various combinations of bins 202, drawers 204, and shelves 206 mounted within one or more of the chilled chambers. Bins 202, drawers 204, and shelves 206 are configured for receipt of food items (e.g., beverages and/or solid food items) and may assist with organizing such food items.

In addition to the fresh food chamber 122 and the freezer chamber 124, one or more chilled chambers may be defined in one or both of the door 126 and 128. For example, one or both of the refrigerator doors, e.g., both right door 126 and left door 128 as in the illustrated example, may include an outer casing 121 (FIG. 2) comprising a thermally insulated wall 125 (FIG. 2) that defines one or more chilled chambers therein. For example, the right door 126 may include one or more fresh food storage chambers 123 and the left door 128 may include at least one flexible chamber, e.g., one or more storage chambers which are operable at a selected temperature within a wide range of temperatures, including temperatures both above and below the freezing point of water. In the example illustrated in FIGS. 1 and 2, the left door 128 includes a first flexible chamber 300, a second flexible chamber 301, and a third flexible chamber 302. The flexible chambers 300, 301, and 302 are separated and partially defined by thermally insulated partitions 304. The thermally insulated partitions 304 may at least partially thermally isolate each flexible chamber 300, 301, and 302 from an adjacent flexible chamber or chambers, allowing the flexible chambers 300, 301, and 302 to be operated at distinct temperatures. As shown, each door 126 and 128 may include a front panel 127 rotatably mounted to the outer casing 121 of each door 126 and 128 such that the front panel 127 permits access to the chilled chambers within the respective door, e.g., the fresh food storage chamber(s) 123 in right door 126 and the plurality of flexible chambers 300, 301, and 302 in left door 128, when the door 126 or 128 is in the closed position, as shown for example in FIG. 1.

The sealed system 60 may be in fluid communication with the various chilled chambers to provide the chilled air to the chambers separately or in various combinations. In particular, the sealed system 60 may be selectively in fluid communication with one or more of the flexible chambers 300, 301, and 302. For example, a first conduit 54 may extend between and provide fluid communication from the sealed system 60 to the fresh food storage chambers 122 and 123, a second conduit 56 may extend between and provide fluid communication from the sealed system 60 to the freezer chamber 124, and a third conduit 58 may extend between and provide fluid communication from the sealed system 60 to the plurality of flexible chambers 300, 301, and 302. Selective fluid communication from the sealed system 60 to one or more of the flexible chambers 300, 301, and 302 may be provided by a valve (embodiments of which are described in more detail below) between the sealed system 60 and the flexible chambers 300, 301, and 302.

In various embodiments, the fresh food storage chambers 122 and 123 may be selectively operable within a first temperature range and the flexible chambers 300, 301, and 302 may be selectively operable within a second temperature range wider than the first temperature range. For example, the flexible chambers 300, 301, and 302 may be operable at a temperature lower than the temperature of the fresh food storage chambers 122 or 123, including temperatures at or below the freezing point of water, such that one or more of the flexible chambers 300, 301, and 302 may serve as an in-door freezer chamber. As another example, the flexible chambers 300, 301, and 302 may be operable at a temperature higher than the temperature of the fresh food storage chambers 122 and 123, such as for chilling wine, certain vegetables, etc.

For example, the first temperature range of the fresh food chamber 122 may be between approximately thirty-three degrees Fahrenheit (33° F.) and approximately forty (40° F.) degrees Fahrenheit, such as between approximately thirty-five degrees Fahrenheit (35° F.) and approximately thirty-eight degrees Fahrenheit (38° F.). Also by way of example, the second temperature range may include temperatures less than thirty-two degrees Fahrenheit (32° F.), such as about ten degrees Fahrenheit (10° F.), such as about zero degrees Fahrenheit (0° F.), and temperatures greater than forty degrees Fahrenheit (40° F.), such as about forty-five degrees Fahrenheit (45° F.) or higher, such as about sixty degrees Fahrenheit (60° F.) or higher, such as about seventy degrees Fahrenheit (70° F.). Still further, it should be understood that fresh food storage chambers 122 and 123 and flexible chambers 300, 301, and 302 may be selectively operable at any number of various temperatures and/or temperature ranges as desired or required per application.

The flexible chambers 300, 301, and 302 may be selectively operable as either fresh food storage chambers or freezer chambers. For example, the flexible chambers 300, 301, and 302 may be operable as fresh food storage chambers wherein the flexible chambers 300, 301, and 302 each provide an internal temperature within one or more of the fresh food storage temperature ranges described above, e.g., above the freezing point of water and below room temperature, such as between approximately thirty-three degrees Fahrenheit (33° F.) and approximately sixty degrees Fahrenheit (60° F.). The flexible chambers 300, 301, and 302 may also be selectively operable to provide internal temperatures below the freezing point of water, e.g., between approximately thirty degrees Fahrenheit (30° F.) and approximately zero degrees Fahrenheit (0° F.), as described above.

As mentioned above, the flexible chambers 300, 301, and 302 may be operated at distinct temperatures. For example, when flexible chambers 300, 301, and 302 are operating as fresh food storage chambers, one of the flexible chambers 300, 301, and 302 may be operable at a relatively warm temperature, such as about fifty degrees Fahrenheit (50° F.), e.g., for chilling wine, and another of the flexible chambers 300, 301, and 302 may be operable at a relatively cool temperature, such as about thirty-seven degrees Fahrenheit (37° F.), e.g., for storing produce. As another example, one of the flexible chambers 300, 301, and 302 may be operated as a fresh food storage chamber, e.g., within a temperature range above the freezing point of water and below room temperature, as described above, while another of the flexible chambers 300, 301, and 302 is operated as a freezer chamber, e.g., within a temperature range including temperatures below the freezing point of water, as described above. Such distinct temperatures may be provided, for example, by using a valve 312 to selectively direct chilled air from the sealed system 60 to a selected one or more of the flexible chambers 300, 301, and/or 302.

Turning now to FIGS. 3 through 19, in various embodiments, the refrigerator appliance 100 may include a plurality of ducts 304, 306, and 308 extending between the sealed system 60 and the flexible chambers 300, 301, and 302. For example, each duct 304, 306, and 308 may extend to an outlet 305, 307, and 309, (FIG. 6) respectively, in a corresponding one of the plurality of flexible chambers 300, 301, and 302. A valve 312 may be provided, e.g., downstream of the third conduit 58 and upstream of the plurality of ducts 304, 306, and 308 to selectively direct the chilled air 1000 from the sealed system 60 to one or more of the plurality of flexible chambers 300, 301, and 302. Thus, in some embodiments, ducts 304, 306, and 308 may extend from the valve 312 to each respective outlet 305, 307, and 309.

Figure 5:
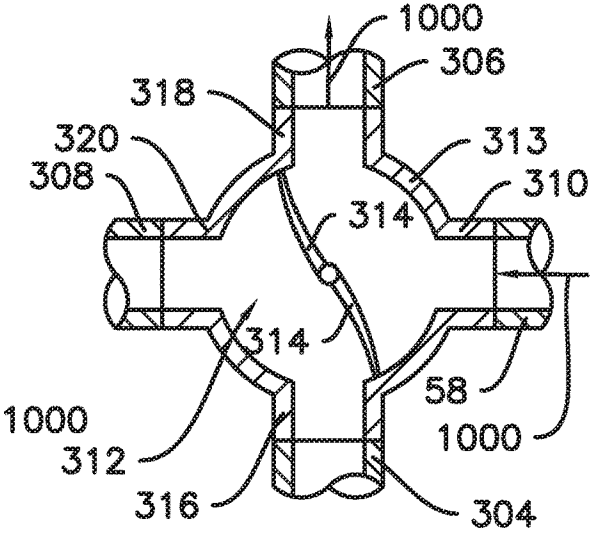
FIG. 5 provides a section view of the exemplary valve of FIG. 3 with the valve in a second position.
Figure 4:
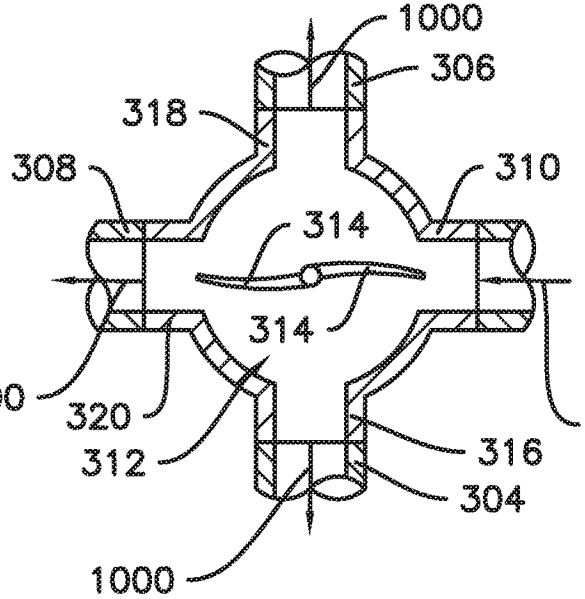
FIG. 4 provides a section view of the exemplary valve of FIG. 3 with the valve in a third position.
Figure 3:
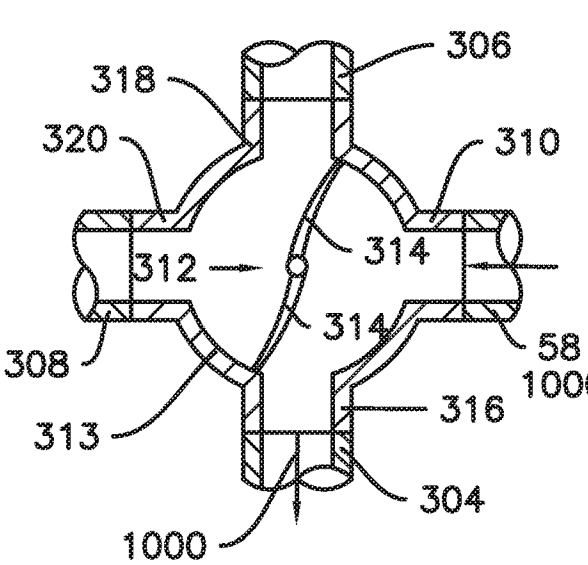
FIG. 3 provides a section view of an exemplary valve as may be used with the present subject matter with the valve in a first position.

In some embodiments, for example, as shown in FIGS. 3 through 5, the valve 312 may comprise a rotary damper including a pair of rotating wiper arms 314. The rotary damper 312 (which is an embodiment of the valve 312) may be disposed in a housing 313. The housing 313 may include an inlet 310 in fluid communication with, e.g., fluidly connected to, the sealed system 60, such as via the third conduit 58. As shown, chilled air 1000 may enter the housing 313 at the inlet 310 and may selectively be directed from the housing 313 via one of the ducts 304, 306, and/or 308 to one or more of the flexible chambers 300, 301, and 302. For example, the housing may include a plurality of outlets 316, 318, and 320. Each outlet of the plurality of outlets 316, 318, and 320 may be in fluid communication with, e.g., fluidly connected to, a corresponding one of the plurality of ducts 304, 306, and 308. The rotatable damper 312 may be rotatable to selectively provide fluid communication from the inlet 310 of the housing 313 to at least one of the plurality of outlets 316, 318, and 320 of the housing 313. For example, as shown in FIG. 3, the rotary damper 312 may be rotated to a first position providing fluid communication from the inlet 310 of the housing 313 to the first outlet 316 and first duct 304. As shown in FIG. 5, the rotary damper 312 may be rotated to a second position providing fluid communication from the inlet 310 of the housing 313 to the second outlet 318 and second duct 306. As shown in FIG. 4, the rotary damper 312 may be rotated to a third position providing fluid communication from the inlet 310 of the housing 313 to the first outlet 316, the second outlet 318 and the third outlet 320.

Figure 6:
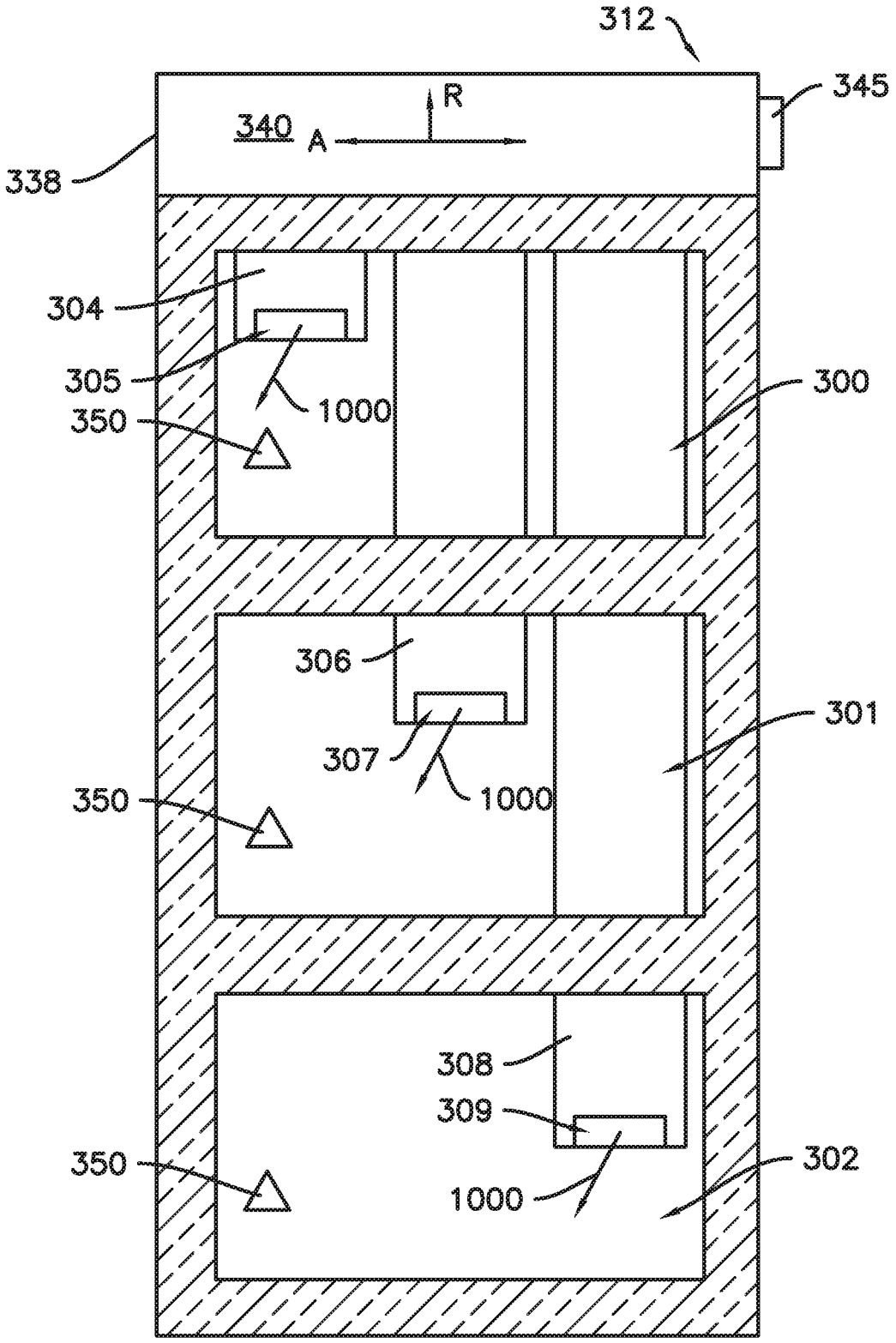
FIG. 6 provides a section view of a door for a refrigerator appliance according to one or more embodiments of the present subject matter.
Figure 7:
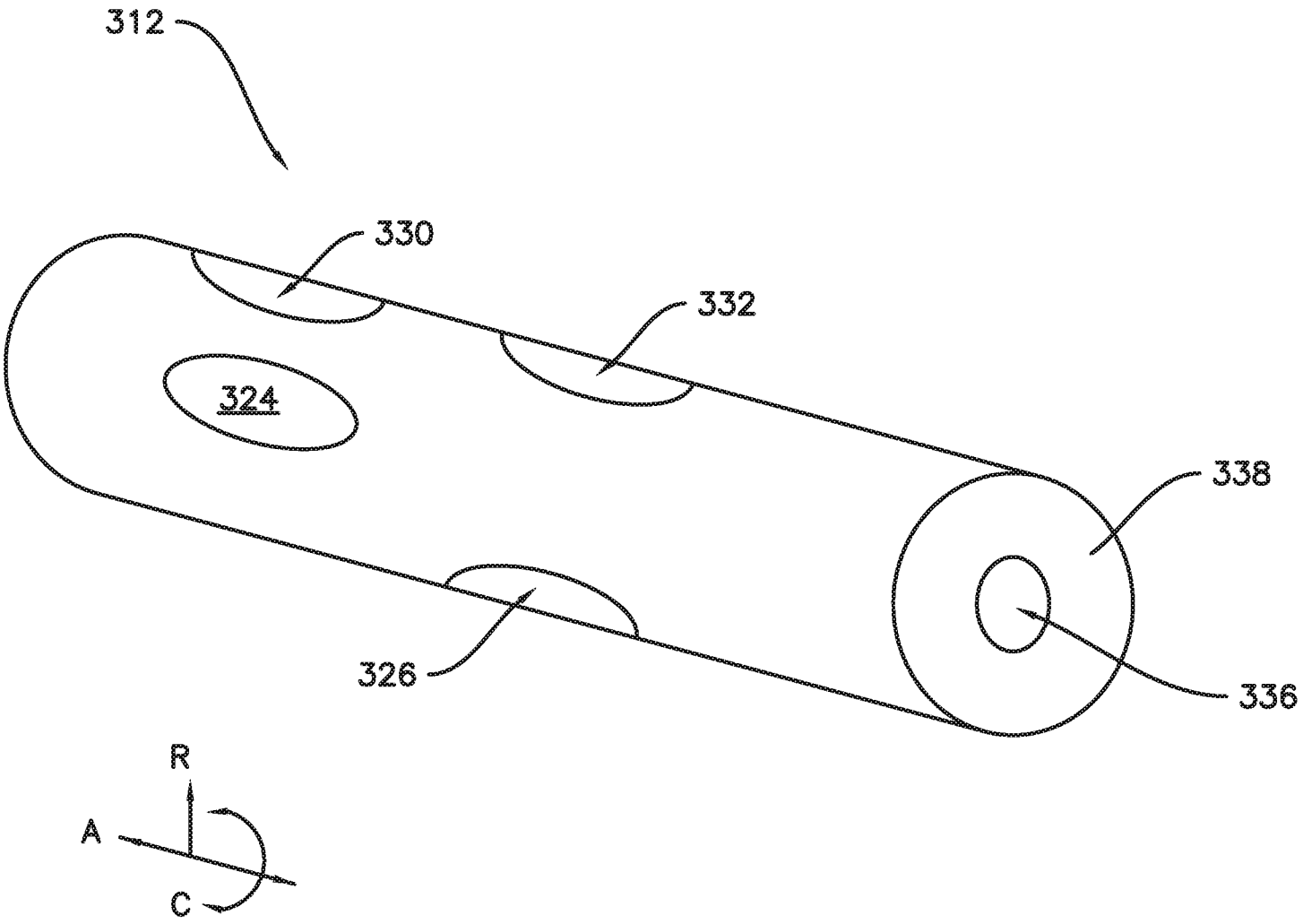
FIG. 7 provides a perspective view of an exemplary valve as may be used with the present subject matter.

In some embodiments, as shown in FIG. 6, the valve 312 may include a cylindrical body defining an axial direction A, a radial direction R perpendicular to the axial direction A, and a circumferential direction C (FIGS. 7-19) extending around the axial direction A. The cylindrical body 312 (which is an embodiment of the valve 312) may include an axially-oriented inlet 336 (FIG. 7) defined in an end face 338 of the cylindrical body 312 and a plurality of radially-oriented outlets defined in a side surface 340 (FIGS. 8-11) of the cylindrical body 312. In such embodiments, the ducts 304, 306, and 308 may be spaced apart along the axial direction A and the plurality of radially-oriented outlets may be spaced apart along the axial direction A such that each of the plurality of radially-oriented outlets is aligned with one of the plurality of ducts 304, 306, and 308 along the axial direction A. A motor 345 may be connected to the valve 312 and operable to rotate the valve 312 about the axial direction A. Also as shown in FIG. 6, the refrigerator appliance 100 may include a plurality of temperature sensors 350, e.g., thermistors, disposed in each flexible chamber 300, 301, and 302 and configured for sensing a temperature within each of the flexible chambers 300, 301, and 302.

As may be seen in FIGS. 7 through 19, the plurality of radially-oriented outlets may be spaced apart along the circumferential direction C such that rotating the valve 312 about the axial direction A selectively provides fluid communication from at least one of the radially-oriented outlets to at least one corresponding duct of the plurality of ducts 304, 306, and 308. In the embodiment illustrated in FIG. 7, the valve 312 includes a plurality of radially-oriented outlets 324, 326, 330, and 332, which are spaced apart along the circumferential direction C.

Figure 8:
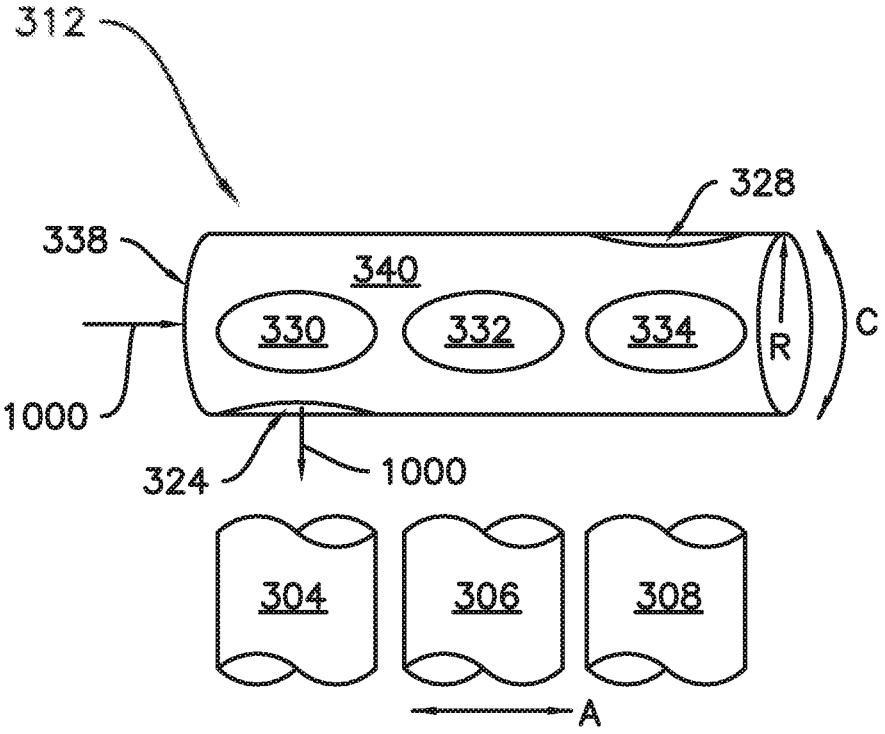
FIG. 8 provides a side view of an exemplary valve as may be used with the present subject matter.
Figure 9:
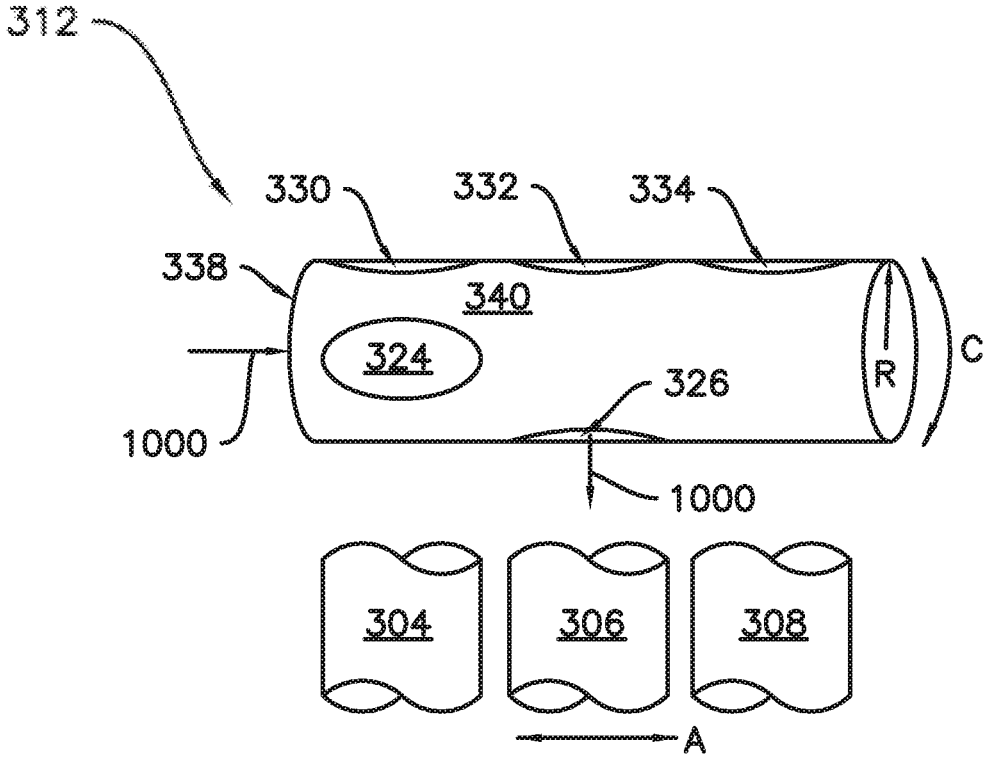
FIG. 9 provides an additional side view of the valve of FIG. 7.
Figure 10:
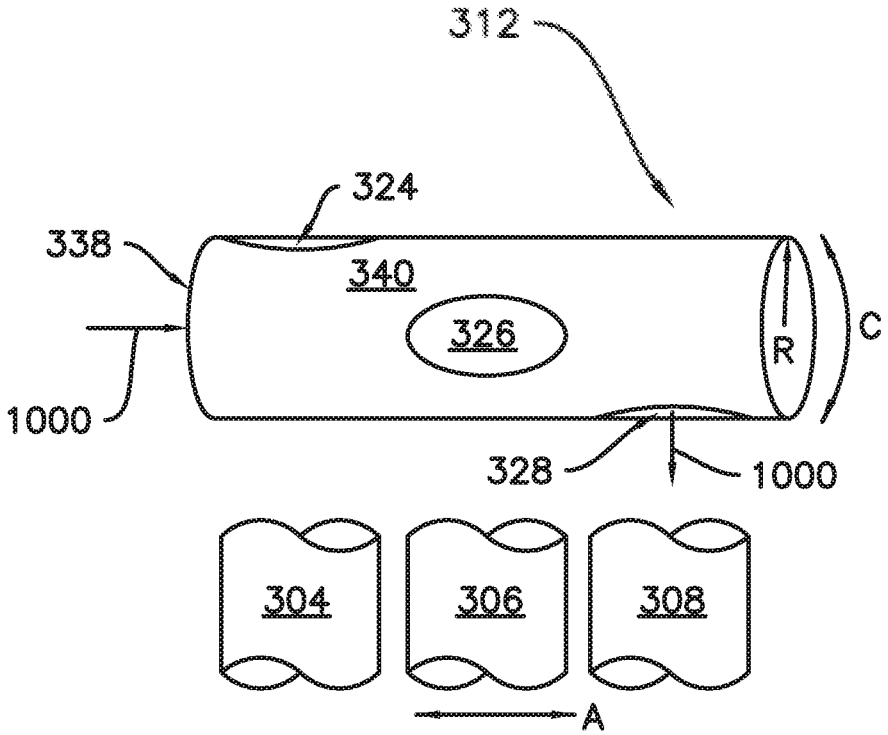
FIG. 10 provides another additional side view of the valve of FIG. 7.
Figure 11:
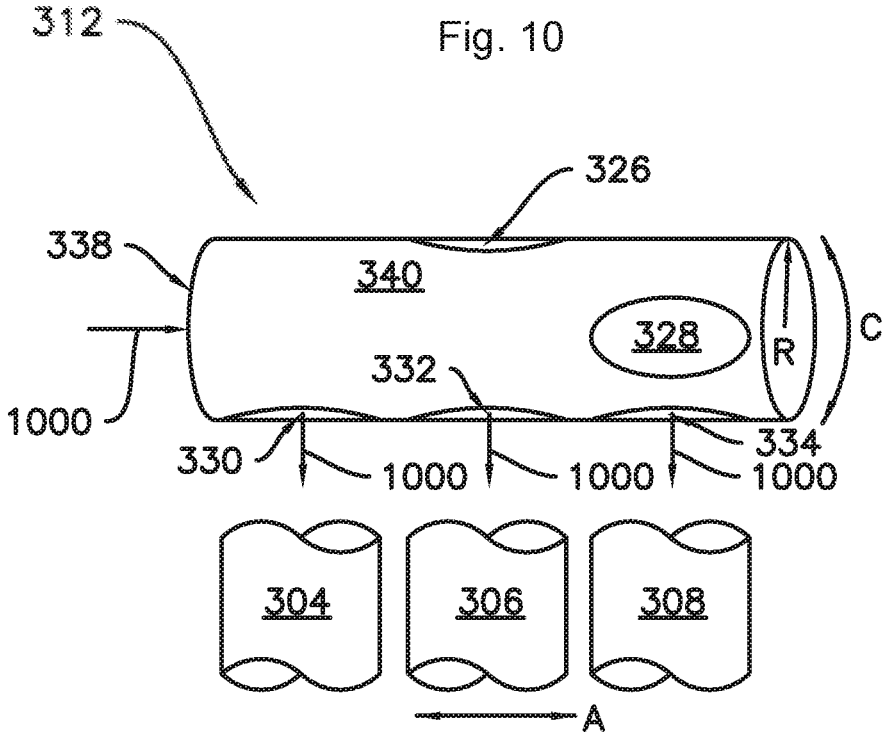
FIG. 11 provides another additional side view of the valve of FIG. 7.

In the embodiment illustrated in FIGS. 8-11, the valve 312 includes a first radially-oriented outlet 324 axially aligned with the first duct 304, a second radially-oriented outlet 326 axially aligned with the second duct 306, a third radially-oriented outlet 328 axially aligned with the third duct 308, a fourth radially-oriented outlet 330 axially aligned with the first duct 304, a fifth radially-oriented outlet 332 axially aligned with the second duct 306, and a sixth radially-oriented outlet 334 axially aligned with the third duct 308. In some embodiments, the radially-oriented outlets may be spaced apart along the circumferential direction by about ninety degrees (90°). In such embodiments, the valve 312 may be rotatable between at least four positions, for example as illustrated in FIGS. 8-11. For example, as shown in FIG. 8, the valve 312 may be rotatable, e.g., by the motor 345, to a first position where the first radially-oriented outlet 324 is in fluid communication with the first duct 304. As shown in FIG. 9, the valve 312 may also be rotatable to a second position, about ninety degrees (90°) from the first position of FIG. 8 along the circumferential direction C, where the second radially-oriented outlet 326 is in fluid communication with the second duct 306. As shown in FIG. 10, a further ninety degree (90°) rotation brings the valve 312 to a third position, where the third radially-oriented outlet 328 is in fluid communication with the third duct 308. In various embodiments, one or more of the fourth radially-oriented outlet 330, fifth radially-oriented outlet 332, and sixth radially-oriented outlet 334 may be provided. In such embodiments, a further ninety degree (90°) rotation from the position shown in FIG. 10 brings the valve 312 to a fourth position, as shown in FIG. 11, where chilled air 1000 may be provided to a combination of the ducts 304, 306, and 308, such as to all three ducts 304, 306, and 308, via the fourth radially-oriented outlet 330, the fifth radially-oriented outlet 332, and the sixth radially-oriented outlet 334, respectively.

As may be seen from FIGS. 8 through 11, the first, second, and third radially-oriented outlets 324, 326, and 328 are each spaced apart from each other along the axial direction A and the circumferential direction C. Also as may be seen from FIGS. 8-11, the fourth, fifth, and sixth radially-oriented outlets 330, 332, and 334 are each spaced apart from each other along the axial direction A and are mutually aligned along the circumferential direction C while being spaced apart from the first, second, and third radially-oriented outlets 324, 326, and 328 along the circumferential direction C. For example, each circumferential spacing may be about ninety degrees) (90° along the circumferential direction C. Thus, the first radially-oriented outlet 324 may be about ninety degrees (90°) from the second radially-oriented outlet 326 in a first direction along the circumferential direction C, and about ninety degrees (90°) from each of the fourth, fifth, and sixth radially-oriented outlets 330, 332, and 334 in a second direction along the circumferential direction C opposite from the first direction. Also, the first radially-oriented outlet 324 may be about one hundred and eighty degrees (180°) from the third radially-oriented outlet 328 along the circumferential direction C and the second radially-oriented outlet 326 may be about one hundred and eighty degrees (180°) from each of the fourth, fifth, and sixth radially-oriented outlets 330, 332, and 334 along the circumferential direction C.

As illustrated in FIGS. 12 through 19, in some embodiments, the radially-oriented outlets may be spaced apart by about ninety degrees (90°), and the motor 345 (FIG. 6) may be operable to rotate the valve 312 in increments of about forty-five degrees (45°). Thus the valve 312 may be selectively rotatable to one of eight positions, each position about forty-five degrees (45°) from a next preceding or subsequent position, to provide chilled air 1000 to one or more of the flexible chambers 300, 301, and/or 302, based on the location and configuration of the radially-oriented outlets in the valve 312.

FIGS. 12 through 19 provide transverse sectional views through the valve 312 and one of the ducts, e.g., first duct 304, looking towards the remaining ducts 306 and 308 (FIG. 6). As shown in FIGS. 12 through 19, in some embodiments, the valve 312 may include at least the first radially-oriented outlet 324 aligned with the first duct 304 along the axial direction A, the second radially-oriented outlet 326 spaced apart from the first radially-oriented outlet 324 by about ninety degrees (90°) along the circumferential direction C and aligned with one of the second duct 306 and the third duct 308 (which are behind the first duct 304 in the view of FIGS. 12 through 19) along the axial direction A, the third radially-oriented outlet 328 which may be spaced apart from the second radially-oriented outlet 326 by about ninety degrees (90°) along the circumferential direction C, spaced apart from the first radially-oriented outlet 324 by about one hundred eighty degrees (180°) along the circumferential direction C and aligned with one of the second duct 306 and the third duct 308 along the axial direction A, and the fourth radially-oriented outlet 330 which may be spaced apart from the first and third radially-oriented outlets 324 and 328 by about ninety degrees) (90° in opposite directions along the circumferential direction C, spaced apart from the second radially-oriented outlet 326 by about one hundred eighty degrees (180°) along the circumferential direction C and aligned with one of the first duct 304 along the axial direction A. In such embodiments, additional radially oriented outlets may also be provided, e.g., which are aligned with any one of the illustrated radially-oriented outlets 324, 326, 328, and 330 along the circumferential direction C and spaced from the one of the illustrated radially-oriented outlets 324, 326, 328, and 330 along the axial direction A such that the additional radially-oriented outlet(s), if provided, may be aligned with one of the plurality of ducts, e.g., one of the second duct 306 and the third duct 308, which are behind the first duct 304 in the view of FIGS. 12 through 19.

Figure 12:
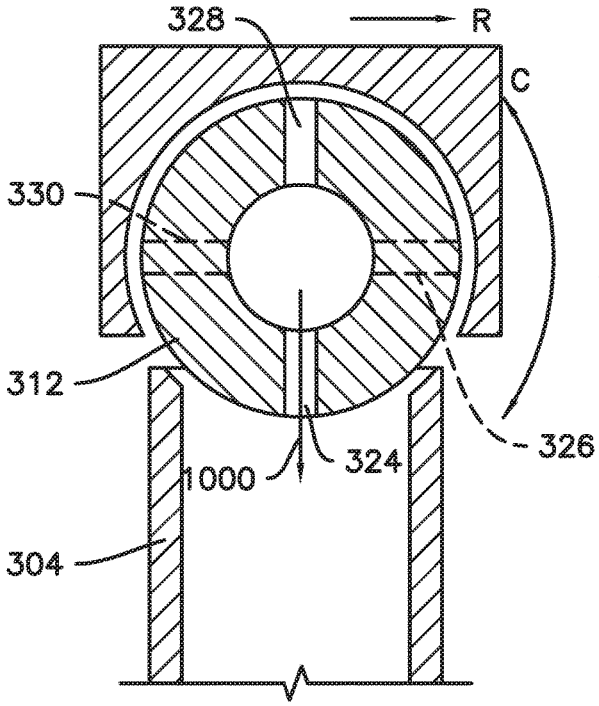
FIG. 12 provides a transverse sectional view of an exemplary valve as may be used with the present subject matter with a first outlet of the valve in fluid communication with a corresponding duct.

As shown in FIG. 12, the valve 312 may be rotatable to a first position where the first radially-oriented outlet 324 is in fluid communication with the first duct 304 to provide chilled air 1000 to the first flexible chamber 301. In additional embodiments, one or more additional radially-oriented outlets may be provided which are circumferentially aligned with the first radially-oriented outlet 324 and axially aligned with one of the second duct 306 and the third duct 308 to provide chilled air 1000 thereto when the valve 312 is in the first position.

Figure 13:
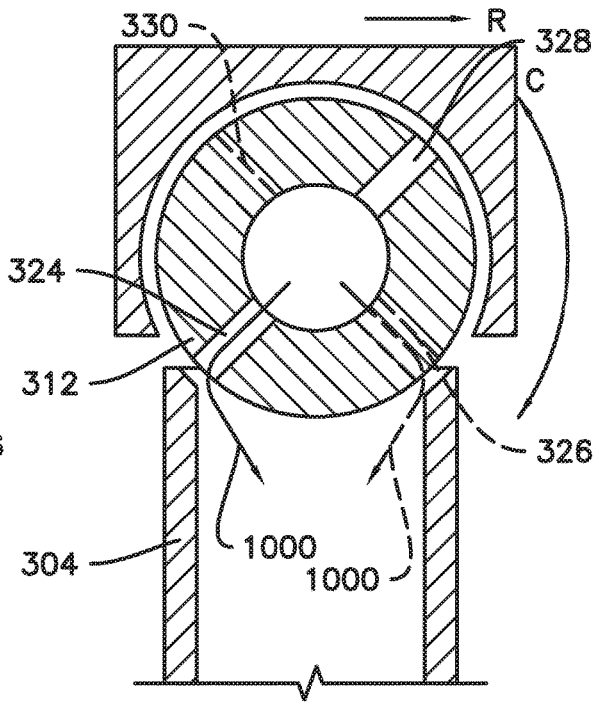
FIG. 13 provides a transverse sectional view of the valve of FIG. 11 with the first outlet and a second outlet of the valve each in fluid communication with a corresponding duct.

As shown in FIG. 13, the ducts may be wide enough to accommodate two outlets from the valve 312 when the valve 312 is rotated by forty-five degrees (45°) along the circumferential direction C. Thus, the valve 12 may be rotatable to a second position, shown in FIG. 13, where the first radially-oriented outlet 324 and the second radially-oriented outlet 326 are each in fluid communication with a corresponding duct 304, 306, or 308 and flexible chamber 300, 301, or 302.

Figure 14:
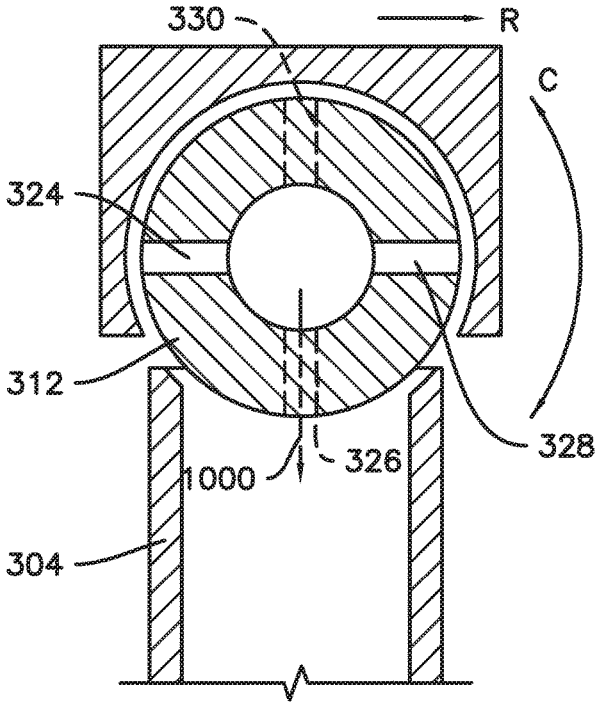
FIG. 14 provides a transverse sectional view of the valve of FIG. 11 with the second outlet of the valve in fluid communication with a corresponding duct.

As shown in FIG. 14, the valve 312 may further be rotatable to a third position wherein the second radially-oriented outlet 326 is in fluid communication with a corresponding duct, e.g., one of the second duct 306 and the third duct 308. In some embodiments, an additional radially-oriented outlet may be provided which is circumferentially aligned with the second radially-oriented outlet 326 and axially aligned with the other of the second duct 306 and the third duct 308, e.g., where the second radially-oriented outlet 326 is axially aligned with the second duct 306, an additional radially-oriented outlet may be provided which is circumferentially aligned with the second radially-oriented outlet 326 and axially aligned with the third duct 308.

Figure 15:
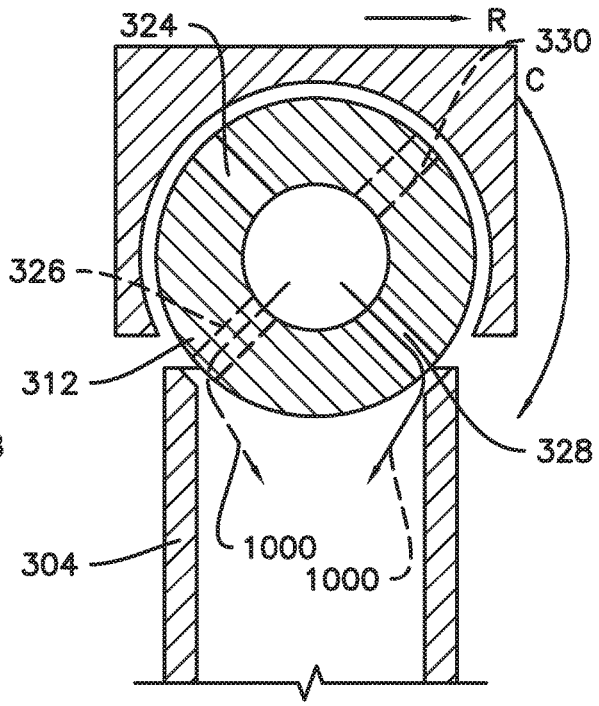
FIG. 15 provides a transverse sectional view of the valve of FIG. 11 with the second outlet and a third outlet of the valve each in fluid communication with a corresponding duct.

As shown in FIG. 15, the valve 312 may further be rotatable to a fourth position wherein the second outlet 326 is in fluid communication with a corresponding duct, e.g., one of the second duct 306 and the third duct 308, and the third outlet 328 is in fluid communication with the first duct 304.

Figure 16:
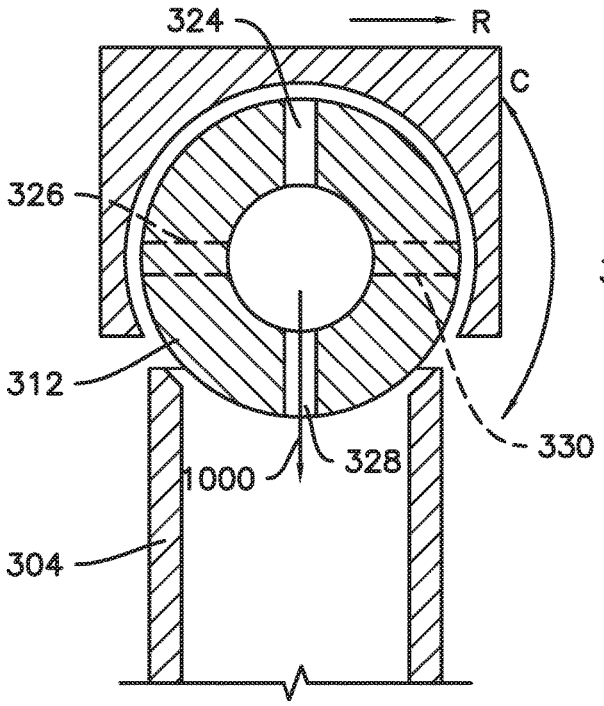
FIG. 16 provides a transverse sectional view of the valve of FIG. 11 with the third outlet of the valve in fluid communication with a corresponding duct.

As shown in FIG. 16, the valve 312 may further be rotatable to a fifth position wherein the third outlet 328 is in fluid communication with the first duct 304.

Figure 17:
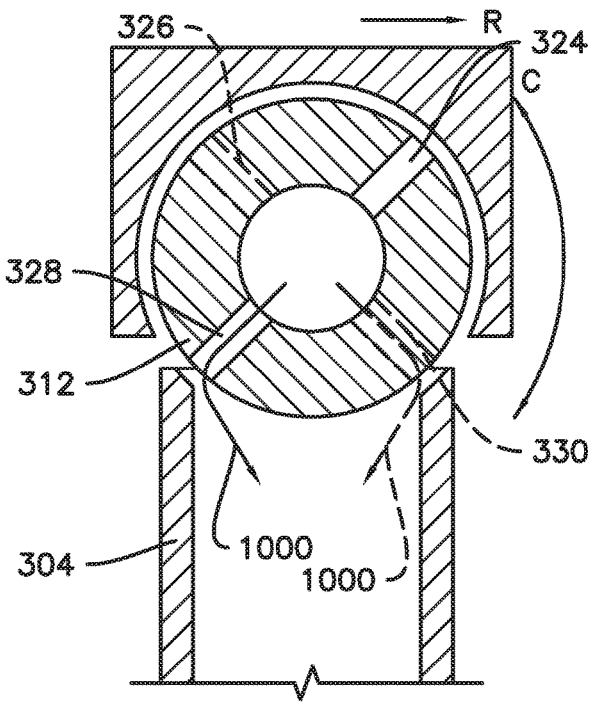
FIG. 17 provides a transverse sectional view of the valve of FIG. 11 with the third outlet and a fourth outlet of the valve each in fluid communication with a corresponding duct.

As shown in FIG. 17, the valve 312 may further be rotatable to a sixth position where the third outlet 328 is in fluid communication with the first duct 304 and the fourth outlet 330 is in fluid communication with a corresponding duct, e.g., one of the second duct 306 and the third duct 308. In additional embodiments, one or more additional radially-oriented outlets may be provided which are circumferentially aligned with the third radially-oriented outlet 328 and axially aligned with one of the second duct 306 and the third duct 308 to provide chilled air 1000 thereto when the valve 312 is in the fifth position and the sixth position.

Figure 18:
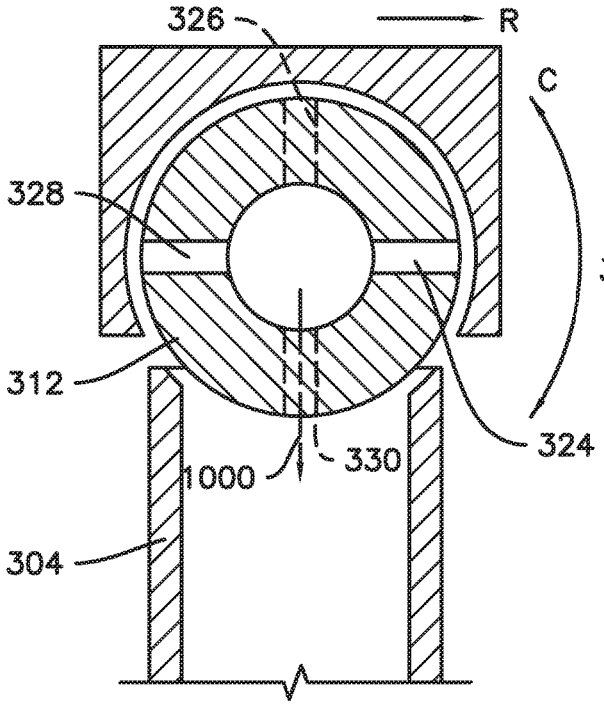
FIG. 18 provides a transverse sectional view of the valve of FIG. 11 with the fourth outlet of the valve in fluid communication with a corresponding duct.

As shown in FIG. 18, the valve 312 may further be rotatable to a seventh position where the fourth outlet 330 is in fluid communication with the corresponding duct.

Figure 19:
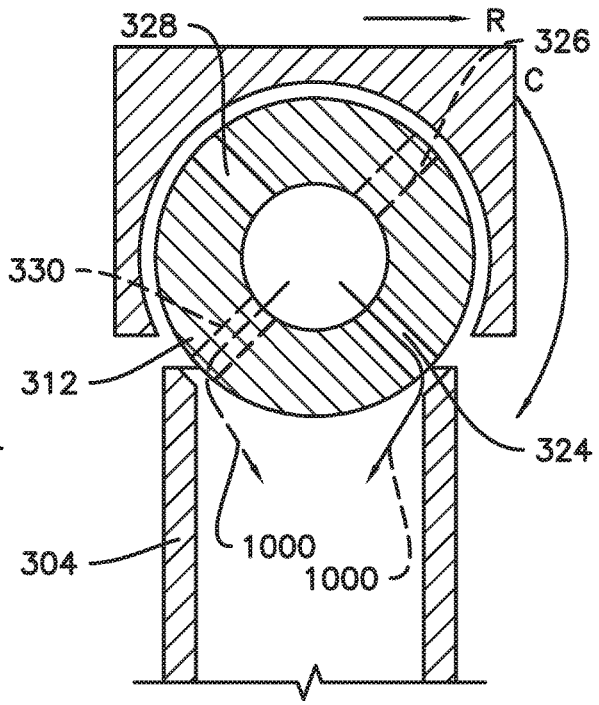
FIG. 19 provides a transverse sectional view of the valve of FIG. 11 with the fourth outlet and the first outlet of the valve each in fluid communication with a corresponding duct.

As shown in FIG. 19, the valve 312 may further be rotatable to an eighth position where the where the fourth outlet 330 is in fluid communication with the corresponding duct and the first outlet 324 is in fluid communication with the first duct 304.

Providing the valve 312 according to one or more of the above-described embodiments permits the flexible chambers 300, 301, and 302 to be selectively adjustable over a wide range of operating temperatures. The valve 312 of the present subject matter advantageously provide a desired amount of chilled air 1000 to each flexible chamber 300, 301, and 302 to control the temperature of each flexible chamber 300, 301, and 302 as desired for a wide range of possible uses.

Providing access to the flexible chambers 300, 301, and 302 via the front panel 127 of the door 128 may advantageously increase accessibility of food items stored in the flexible chambers 300, 301, and 302. For example, smaller food items such as a bag of frozen vegetables or a single-serving beverage container may be stored in the flexible chambers 300, 301, and 302 to prevent or reduce such items from being obscured under or behind larger items such as a frozen turkey, frozen pizza, gallon of milk, etc., as compared to when only a single chamber or portion of the refrigerator appliance 100 is provided for storing fresh food or frozen items. Additionally, reducing the number of times the door 128 is opened may also advantageously reduce the energy consumption of the refrigerator appliance, where the relatively smaller volume of the flexible chambers 300, 301, and 302 can be more readily chilled after opening the front panel 127 only as compared to chilling the entire fresh food storage chamber 122 after opening the door 128.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction and a transverse direction, the vertical, lateral and transverse directions being mutually perpendicular, the refrigerator appliance comprising:

a cabinet extending from a top to a bottom along the vertical direction, the cabinet also extending from a left side to a right side along the lateral direction, the cabinet defining a fresh food chamber, the fresh food chamber extending along the vertical direction between the top and the bottom of the cabinet, along the lateral direction between the left and right sides of the cabinet, and along the transverse direction between a front portion and a back portion, the front portion of the fresh food storage chamber defining an opening for receipt of food items;

a door rotatably mounted to the cabinet at the front portion of the fresh food storage chamber such that the door rotates between a closed position where the door sealingly encloses at least a portion of the fresh food storage chamber and an open position to permit access to the fresh food chamber, the door comprising an outer casing comprising a thermally insulated wall that defines a plurality of flexible chambers within the outer casing, the door further comprising a front panel rotatably mounted to the outer casing of the door such that the front panel of the door permits access to the plurality of flexible chambers when the door is in the closed position;

a sealed system configured for generating chilled air, the sealed system in fluid communication with each of the plurality of flexible chambers to selectively provide the chilled air to at least one of the plurality of flexible chambers;

a plurality of ducts, each duct extending between the sealed system and an outlet in a corresponding one of the plurality of flexible chambers; and a valve configured to selectively direct the chilled air from the sealed system to one or more of the plurality of flexible chambers.

2. The refrigerator appliance of claim 1, wherein the valve comprises a rotary damper disposed in a housing.

3. The refrigerator appliance of claim 2, wherein the housing comprises an inlet and a plurality of outlets, each outlet of the plurality of outlets in fluid communication with a corresponding one of the plurality of ducts, and wherein the rotatable damper is rotatable to selectively provide fluid communication from the inlet of the housing to at least one of the plurality of outlets of the housing.

4. The refrigerator appliance of claim 2, wherein the plurality of flexible chambers comprises a first flexible chamber, a second flexible chamber, and a third flexible chamber, the plurality of ducts comprises a first duct having an outlet in the first flexible chamber, a second duct having an outlet in the second flexible chamber, and a third duct having an outlet in the third flexible chamber, and the housing comprises a first outlet in fluid communication with the first duct, a second outlet in fluid communication with the second duct, and a third outlet in fluid communication with the third duct, wherein the rotary damper is rotatable between a first position providing fluid communication from an inlet of the housing to the first outlet, a second position providing fluid communication from the inlet of the housing to the second outlet, and a third position providing fluid communication from the inlet of the housing to the first outlet, the second outlet and the third outlet.

5. The refrigerator appliance of claim 1, wherein the valve comprises a cylindrical body defining an axial direction, a radial direction perpendicular to the axial direction, and a circumferential direction extending around the axial direction, the cylindrical body including an axially-oriented inlet defined in an end face of the cylindrical body and a plurality of radially-oriented outlets defined in a side surface of the cylindrical body.

6. The refrigerator appliance of claim 5, further comprising a motor connected to the valve and operable to rotate the valve about the axial direction, wherein the plurality of radially-oriented outlets are spaced apart along the circumferential direction, whereby rotating the valve about the axial direction selectively provides fluid communication from at least one of the radially-oriented outlets to at least one corresponding duct of the plurality of ducts.

7. The refrigerator appliance of claim 6, wherein the outlets are spaced apart by about ninety degrees, and the motor is operable to rotate the valve in increments of about forty-five degrees.

8. The refrigerator appliance of claim 5, wherein the plurality of radially-oriented outlets comprises a first radially-oriented outlet, a second radially-oriented outlet spaced apart from the first radially-oriented outlet along the circumferential direction by about ninety degrees, a third radially-oriented outlet spaced apart from the second radially-oriented outlet along the circumferential direction by about ninety degrees and spaced apart from the first radially-oriented outlet along the circumferential direction by about one hundred and eighty degrees, a fourth radially-oriented outlet spaced apart from the third radially-oriented outlet along the circumferential direction by about ninety degrees, spaced apart from the second radially-oriented outlet along the circumferential direction by about one hundred and eighty degrees, and spaced apart from the first radially-oriented outlet along the circumferential direction by about ninety degrees, and a fifth radially-oriented outlet aligned with the fourth radially-oriented outlet along the circumferential direction and spaced apart from the fourth radially-oriented outlet along the axial direction.

9. The refrigerator appliance claim 8, wherein the fourth radially-oriented outlet is aligned with the first radially-oriented outlet along the axial direction and the fifth radially-oriented outlet is aligned with the second radially-oriented outlet along the axial direction.

10. The refrigerator appliance claim 8, wherein the fourth radially-oriented outlet is aligned with the first radially-oriented outlet along the axial direction and the fifth radially-oriented outlet is aligned with the third radially-oriented outlet along the axial direction.

11. The refrigerator appliance claim 8, further comprising a sixth radially-oriented outlet aligned with the fourth radially-oriented outlet and the fifth radially-oriented outlet along the circumferential direction and spaced apart from the fourth radially-oriented outlet and the fifth radially-oriented outlet along the axial direction.

12. The refrigerator appliance of claim 6, wherein the plurality of ducts are spaced apart along the axial direction and the plurality of radially-oriented outlets are spaced apart along the axial direction and each of the plurality of radially-oriented outlets is aligned with one of the plurality of ducts along the axial direction.

13. The refrigerator appliance of claim 1, wherein the door is a first fresh food chamber door, further comprising a second fresh food chamber door mirrored with the first fresh food chamber door whereby the first fresh food chamber door and the second fresh food chamber door cooperatively sealingly enclose the fresh food chamber when the first fresh food door is in the closed position and the second fresh food door is in a closed position, the second fresh food door comprising a second outer casing and a second thermally insulated wall defining a fresh food storage chamber within the second outer casing.

14. A refrigerator appliance, the refrigerator appliance comprising:

a cabinet defining a chilled chamber, the chilled chamber comprising a front portion and an opening for receipt of food items defined at the front portion;

a door rotatably mounted to the cabinet at the front portion of the chilled chamber such that the door rotates between a closed position where the door sealingly encloses at least a portion of the chilled chamber and an open position to permit access to the chilled chamber, the door comprising an outer casing comprising a thermally insulated wall that defines a plurality of flexible chambers within the outer casing, the door further comprising a front panel rotatably mounted to the outer casing of the door such that the front panel of the door permits access to the plurality of flexible chambers when the door is in the closed position;

a sealed system configured for generating chilled air, the sealed system in fluid communication with each of the plurality of flexible chambers to selectively provide the chilled air to at least one of the plurality of flexible chambers;

a plurality of ducts, each duct extending between the sealed system and an outlet in a corresponding one of the plurality of flexible chambers; and a valve configured to selectively direct the chilled air from the sealed system to one or more of the plurality of flexible chambers.

15. The refrigerator appliance of claim 14, wherein the valve comprises a rotary damper disposed in a housing.

16. The refrigerator appliance of claim 15, wherein the housing comprises an inlet and a plurality of outlets, each outlet of the plurality of outlets in fluid communication with a corresponding one of the plurality of ducts, and wherein the rotatable damper is rotatable to selectively provide fluid communication from the inlet of the housing to at least one of the plurality of outlets of the housing.

17. The refrigerator appliance of claim 14, wherein the valve comprises a cylindrical body defining an axial direction, a radial direction perpendicular to the axial direction, and a circumferential direction extending around the axial direction, the cylindrical body including an axially-oriented inlet defined in an end face of the cylindrical body and a plurality of radially-oriented outlets defined in a side surface of the cylindrical body.

18. The refrigerator appliance of claim 14, further comprising a motor connected to the valve and operable to rotate the valve about the axial direction, wherein the plurality of ducts are spaced apart along the axial direction, wherein the plurality of radially-oriented outlets are spaced apart along the circumferential direction and the axial direction such that each of the plurality of radially-oriented outlets is aligned with one of the plurality of ducts along the axial direction, whereby rotating the valve about the axial direction selectively provides fluid communication from at least one of the radially-oriented outlets to at least one corresponding duct of the plurality of ducts.

* * * * *